US007082783B2

(12) United States Patent
Uihlein et al.

(10) Patent No.: US 7,082,783 B2
(45) Date of Patent: Aug. 1, 2006

(54) STACKED DRAWER REFRIGERATOR

(75) Inventors: Philip J. Uihlein, Mequon, WI (US); Jennifer U. Strazewski, Mequon, WI (US); William A. Reed, Cedarburg, WI (US); Thomas W. Rand, Cedarburg, WI (US); Joseph E. Braun, Brown Deer, WI (US); Jack L. Vaughn, Hartford, WI (US); Andrew J. Doberstein, Hartford, WI (US); Ami M. Verhalen, Sun Prairie, WI (US); Daniel R. Bullis, Jr., Madison, WI (US)

(73) Assignee: U-Line Corporation, Milwaukee, WI (US)

( * ) Notice: Subject to any disclaimer, the term of this patent is extended or adjusted under 35 U.S.C. 154(b) by 319 days.

(21) Appl. No.: 10/665,835

(22) Filed: Sep. 19, 2003

(65) Prior Publication Data

US 2005/0061021 A1 Mar. 24, 2005

(51) Int. Cl.
*F25D 11/02* (2006.01)

(52) U.S. Cl. ..... 62/441

(58) Field of Classification Search ..... 62/441, 62/440, 382; 312/199, 404
See application file for complete search history.

(56) References Cited

U.S. PATENT DOCUMENTS 4,751,826 A * 6/1988 Kawahara et al. ..... 62/382
5,056,332 A * 10/1991 Tajima et al. ..... 62/252
5,277,039 A 1/1994 Haasis
6,253,568 B1 * 7/2001 Peffley ..... 62/441
6,446,459 B1 9/2002 Sawhney et al.
6,447,083 B1 9/2002 Chiapetta et al.
6,449,976 B1 9/2002 Chai et al.

OTHER PUBLICATIONS

Sub-Zero Freezer Company, Inc.; 700BR Refrigerator Drawers; Sub-Zero website—Printed Dec. 15, 2003; Copyright 2002 Sub-Zero Freezer Company, Inc.

* cited by examiner

*Primary Examiner*—Melvin Jones
(74) *Attorney, Agent, or Firm*—Quarles & Brady LLP

(57) ABSTRACT

A drawer refrigerator, including an evaporator, compressor and condenser, has a partitioned cabinet with two vertically stacked pull-out drawers having drawer bins. A single evaporator is located adjacent both drawer cavities and is partitioned to keep the temperature in both drawer bins approximately equal. The pull-out drawers can have a bottle bin with recesses holding the necks of wine, soda or like bottles. The bottle bin slides on the top edges of the drawer bin at its sides and can be moved front to back. The pull-out drawers can have an underside compartment opening at both sides of the drawer containing a removable storage bin. The pull-out drawers can also have an adjustable divider fence with pairs of lateral and transverse divider rods extending between the side walls and between the door panels and the rear walls of the drawer bins. The rods are coupled by a hub having a hand operated screw knob for locking the position of the fence.

27 Claims, 12 Drawing Sheets

STACKED DRAWER REFRIGERATOR

CROSS-REFERENCE TO RELATED APPLICATION

Not applicable.

STATEMENT OF FEDERALLY SPONSORED RESEARCH OR DEVELOPMENT

Not applicable.

BACKGROUND OF THE INVENTION

1. Technical Field

The present invention relates to refrigerated food and drink storage units, and in particular, to compact drawer refrigerators in which the storage space is defined by one or more pull-out door drawers.

2. Description of the Related Art

Refrigerators and coolers for the cold storage of food and beverage items are well known. Many conventional refrigerators and beverage coolers have one or more doors that are hinged to the front side of the cabinet. Food and beverages are ordinarily stored on shelves in the cabinet and the door(s) as well as in slide out crisper drawers near the bottom of the cabinet. This is common for industrial and residential refrigerators and beverage coolers as either full-size standup units or compact, under-cabinet units.

Drawer refrigerators are also well known in which the doors are replaced by pull-out drawers having bins in which the food is stored. Drawer refrigerators can be preferred in certain applications, such as low, under-cabinet applications, because the food items can be slid out of the cabinet in the drawer and thereby be accessed more easily. Often such drawer refrigerators have two, or possibly more, pull-out drawers that are arranged side by side or vertically stacked one above the other so that not all of the items are stored in the same drawer.

One problem with stacked drawer refrigerators is that there is considerable temperature variance between the two drawers, such that one drawer, typically the lower drawer, gets colder than the other. This can frustrate the user because, for example, in order for the upper drawer to be at the desired temperature, the lower drawer may be at a temperature that is colder than it should be for beverages or other items. This can be avoided by using two separate evaporator assemblies for each drawer, but at considerable expense. Or, the refrigerator can have a single evaporator, likely at the bottom of the unit, and an active airflow control assembly, such as including movably louvers and an air mover. Again, however, this adds considerable expense to the unit as well as occupies additional space in the interior which could otherwise be used for cold storage.

Another common issue with drawer refrigerators (with any number or arrangement of drawers) is the efficient allocation of space, that is how to maximize storage capacity within standard height, width and depth dimensions while keeping the items easily accessible. This is a particularly difficult issue to address in drawer refrigerators because of their inherent lack of shelving, unlike conventional hinged door refrigerators, which makes it easy to store items vertically above one another without making them difficult to access, as would be the case if the items were stacked directly on top of each other.

Accordingly, an improved drawer refrigerator with more uniform cooling and improved storage capacity and accessibility features is desired.

SUMMARY OF THE INVENTION

The present invention is a compact pull-out drawer type refrigerator for the cold storage of food and beverages. As conventional, the drawer refrigerator has an evaporator inside the refrigerator cabinet, a compressor receiving return refrigerant from the evaporator and a condenser coupled to the compressor and through a restrictor to the evaporator. The unit has several unique aspects that provide improved functionality over previously existing units.

Specifically, in one aspect the invention provides a drawer refrigerator with a cabinet defining an interior chamber opening to the front of the cabinet and having a partition dividing the chamber into two drawer cavities, one above the other. Two pull-out drawers are slidably mounted to the cabinet so that their drawer bins can be moved into and out of the two drawer cavities. The evaporator is disposed within the cabinet along a rear wall thereof so as to extend adjacent both drawer cavities and partitioned such that the temperature difference within the cabinet is preferably no more than about five degrees Fahrenheit at each drawer cavity when the drawers are unloaded with food items. Preferably, the temperature difference is no more than about 3 degrees, and even more preferably the temperature difference is essentially zero. Also, the cabinet can include a mullion extending between opposite upright side walls at the front opening that supports a front edge of the partition and provides a sealing surface for the drawer gaskets.

In another aspect the invention provides a drawer refrigerator with a cabinet defining a cavity with a front opening. One or more pull-out drawers are slidably mounted to the cabinet. Each pull-out drawer has a front door panel at least partially closing the front opening and a drawer bin mounted to the door panel. The drawer bin supports a bottle bin, which has a bottle retainer receiving a neck of a bottle resting in the bottle bin. Preferably, the bottle retainer is a unitary feature of the bottle bin in the form of a recess in an upright, preferably front, wall of the bottle bin. If desired, the bottle bin can have two or more bottle retainers. The bottle bin has guides at opposite sides that slidably engage the top edges of opposite side walls of the drawer bin so that it slide essentially clear of the drawer bin to allow better access to food stored within the drawer bin otherwise beneath the bottle bin. The bottle bin can have a integral handle at the front wall to aid in sliding it.

In yet another aspect the invention provides a drawer refrigerator with one or more pull-out drawers slidably mounted within the cabinet having a front door panel, a drawer bin mounted to the door panel, and a side access compartment opening to a side of the drawer bin perpendicular to the door panel. The side access compartment houses a removable storage bin accessible from the side of the drawer bin when the drawer is in an open position in which the door panel is spaced sufficiently from the cabinet. Preferably, the side access compartment is located beneath the drawer bin and extends between opposite sides of the drawer bin parallel with the door panel to two open ends so that the storage bin is accessible from either side of the drawer. A removable transparent panel forms a part of the drawer bin bottom and the top of the side access compartment to allow viewing and access therein from above the drawer.

In still another aspect the invention provides a drawer refrigerator in which the storage space of one or more sliding pull-out drawers is compartmentalized by an adjustable divider fence having a lateral divider extending between opposite side walls of the drawer bin and a transverse divider extending between the door panel and the rear wall of the drawer bin. The lateral and transverse dividers are coupled and releasably locked together at a hub such that when the hub is unlocked the transverse divider can slide between the sides of the drawer bin and the lateral divider can slide between the door panel and the rear wall of the drawer bin independent of the position of the other divider. Preferably, the divider fence is a separate component that can be entirely removed from the drawer bin when not needed. There can be two lateral dividers vertically spaced apart in parallel and two transverse members also vertically spaced apart in parallel. The dividers are preferably elongated rods with plastic contact pads at each end. The hub of the divider fence can have a locking member, preferably a hand operable threaded knob, that contacts one of the dividers to presses it against the adjacent perpendicularly extending divider to inhibit relative movement and thus fix the position of the fence. The hub has a body with two sets of two perpendicular openings for coupling the rods.

Thus, the present invention provides a pull-out drawer type refrigerator with several features to improve ease of use and functionality. The sliding bottle bin provides extra storage for wine or like bottles without hampering access to the items stored in the associated drawer bin. The side access compartment also provides additional storage space in a pull out bin that is easily accessible from either side or the top of the associated drawer. The adjustable fence quickly and easily compartmentalizes the drawer bins for segregated storage of items and can be used to secure taller items in place to prevent tipping. The size of the compartments can be adjusted readily by turning the locking knob and sliding the dividers as desired. The dividers can be slid near perpendicular walls of the drawer bin or removed completely when there is no need to divide up the storage space. Finally, the invention provides for nearly constant and equal temperatures at the drawer bins of multiple pull-out drawers using a single partitioned naturally convective evaporator, thereby allowing the user to store items in either drawer without worrying if it is too cold or too warm for the item as well as obviating the need for multiple evaporator assemblies.

These and still other advantages of the invention will be apparent from the detailed description and drawings. What follows is a preferred embodiment of the present invention. To assess the full scope of the invention the claims should be looked to as the preferred embodiment is not intended as the only embodiment within the scope of the invention.

DETAILED DESCRIPTION OF THE PREFERRED EMBODIMENT

Figure 1:
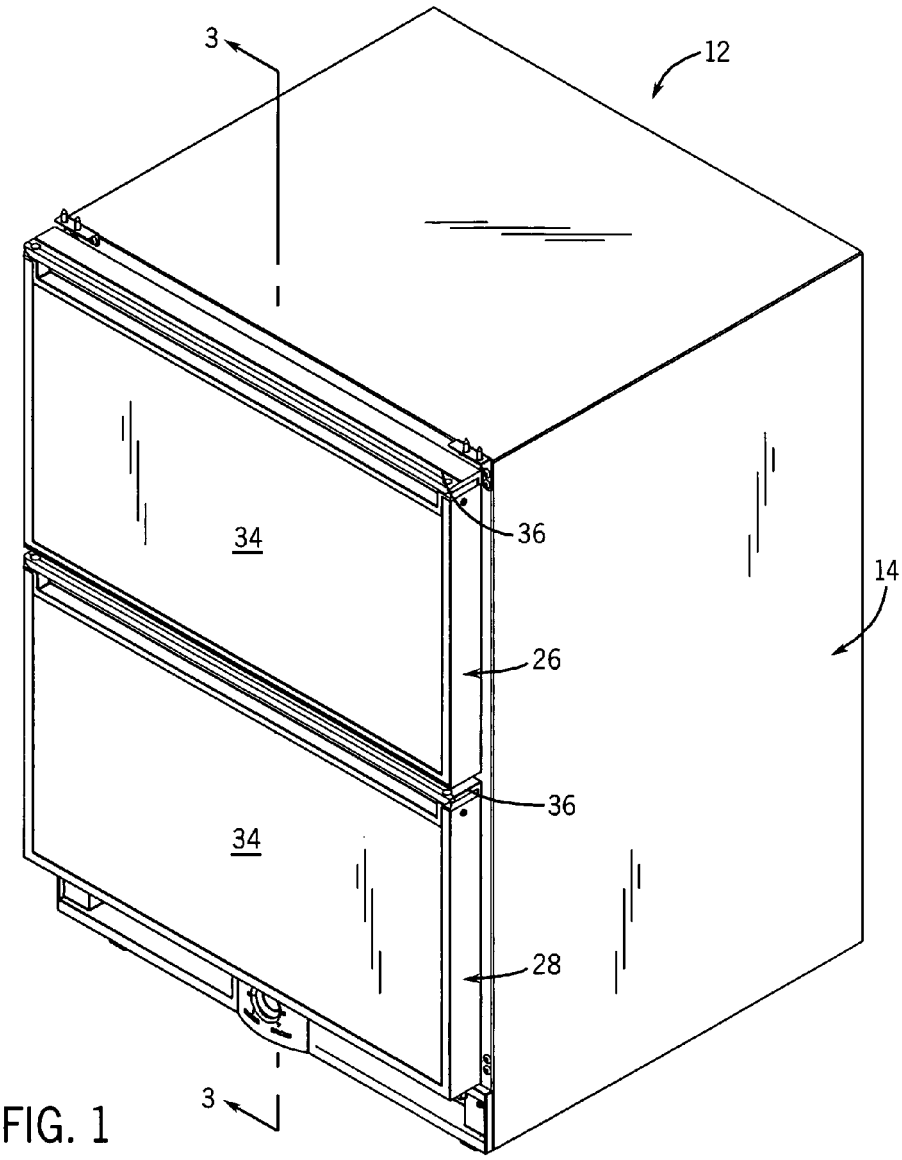
FIG. 1 is a perspective view of the stacked drawer refrigerator of the present invention.
Figure 2:
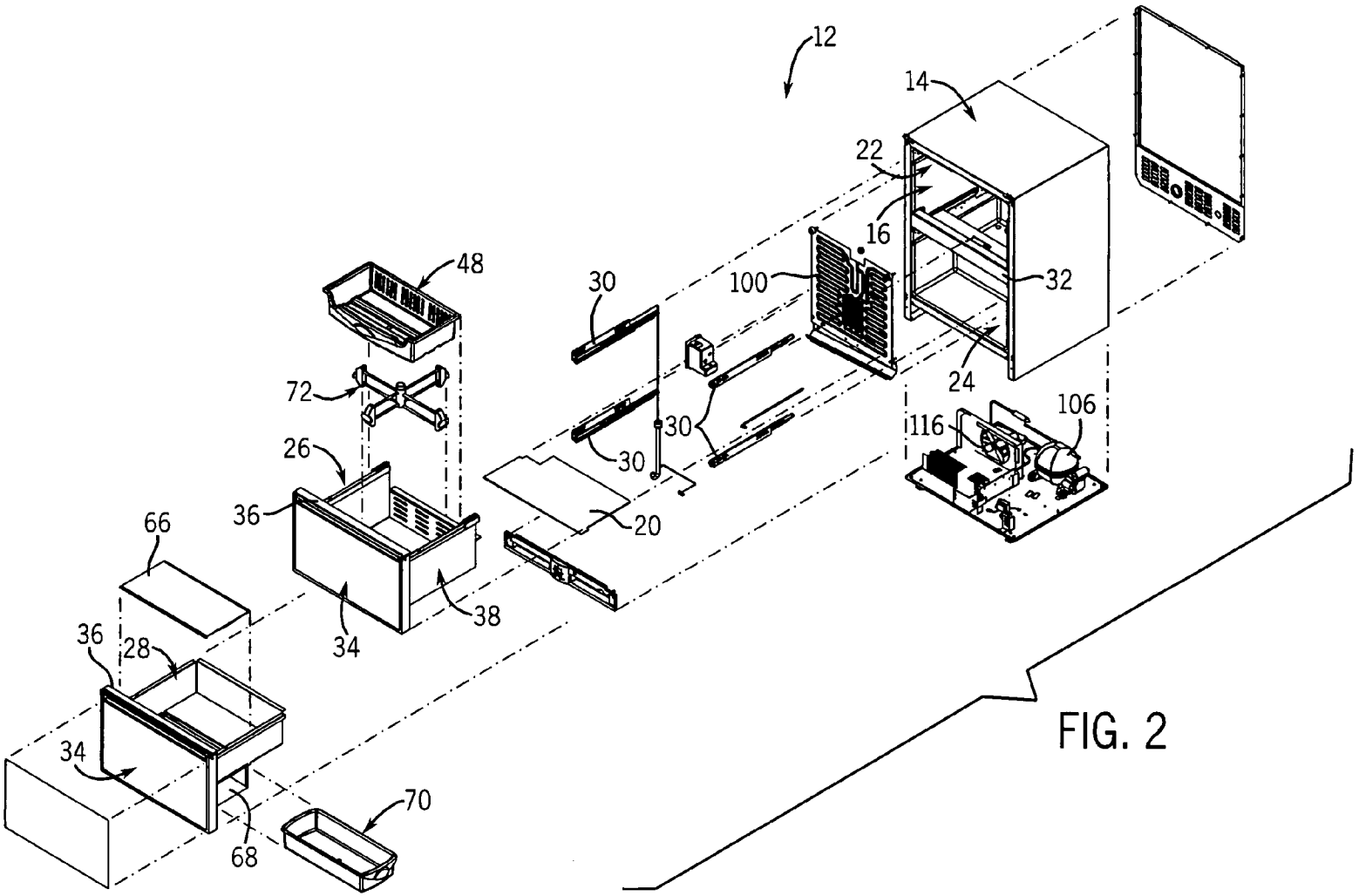
FIG. 2 is an exploded perspective view thereof.
Figure 3:
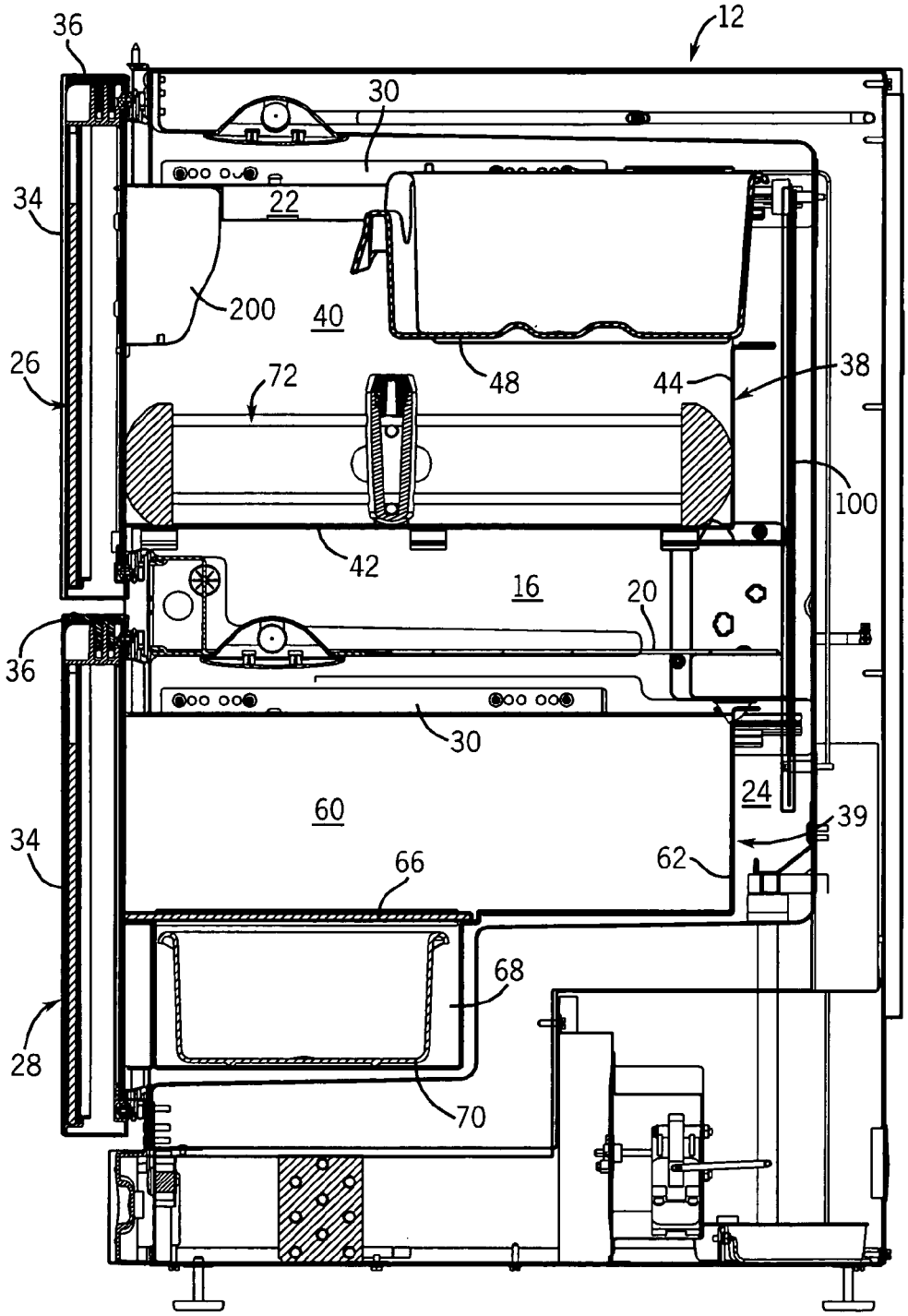
FIG. 3 is a side cross-sectional view taken along line 3—3 of FIG. 1.
Figure 4:
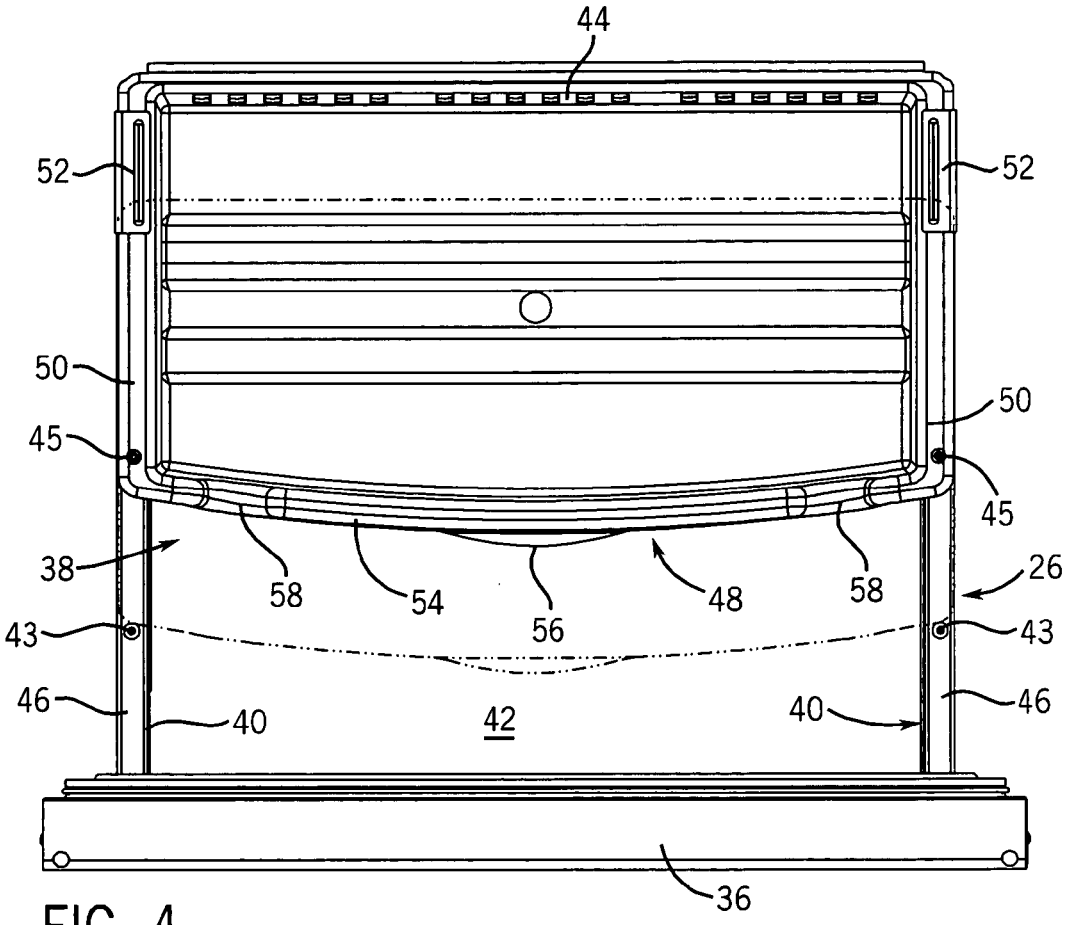
FIG. 4 is a top view looking down into an upper drawer on which a slidable bottle bin rests.
Figure 5:
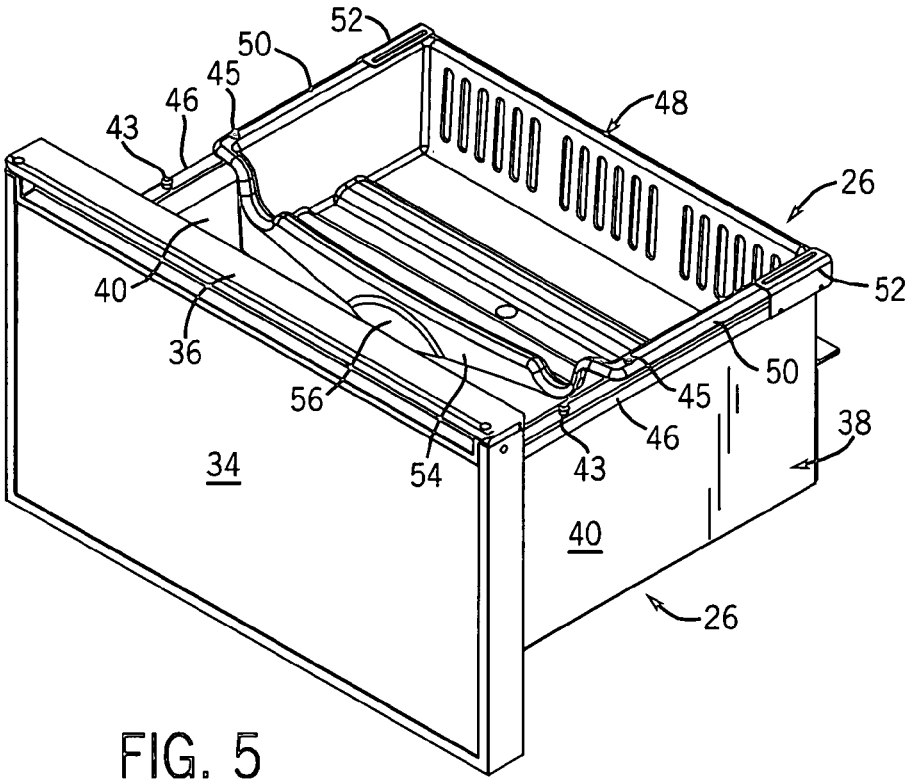
FIG. 5 is a perspective view of the upper drawer with the bottle bin shown positioned at the back of the upper drawer.
Figure 6:
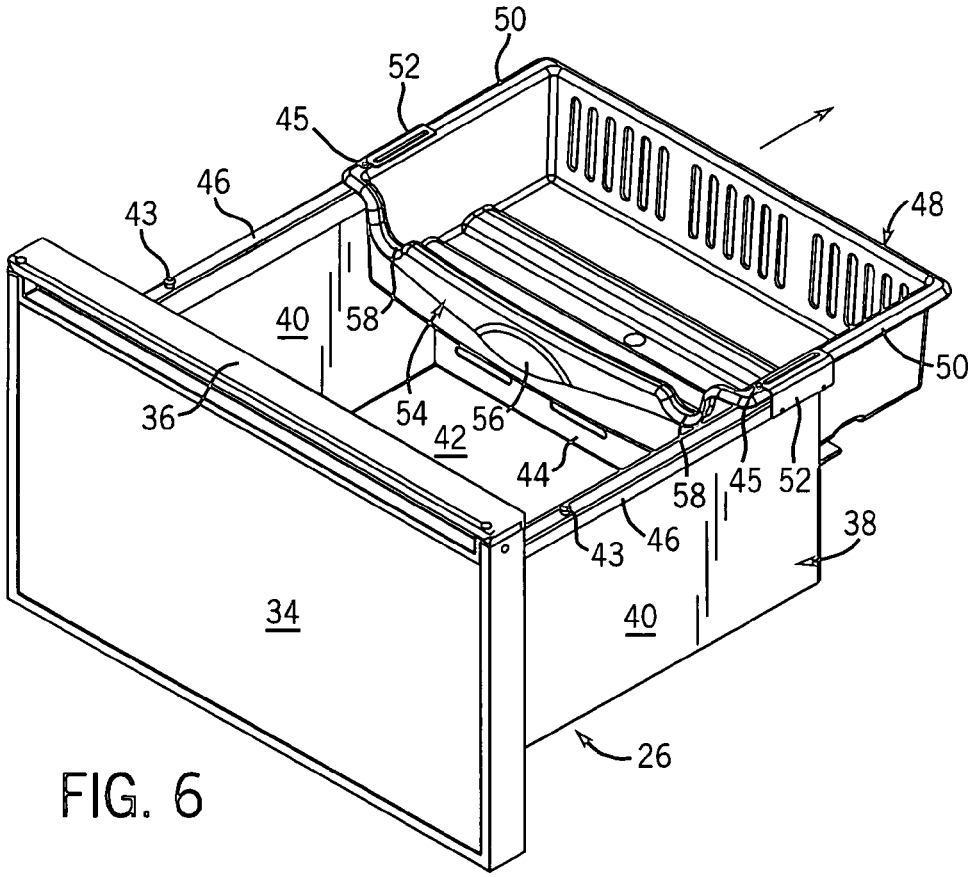
FIG. 6 is a perspective view similar to FIG. 5 albeit with the bottle bin shown in a fully retracted position.

Referring now to FIGS. 1–3, the drawer refrigerator 12 includes a cabinet 14 defining an internal chamber 16 open at a front opening 18. The chamber 16 is divided vertically by a partition 20 into two vertically aligned drawer cavities 22 and 24 in which are mounted two drawers 26 and 28, respectively, by suitable slide mechanisms 30 (see FIG. 3) mounted to the inside of the cabinet 14. The cabinet 14 and the drawers 26 and 28 are formed of inner and outer members, of molded plastic or formed metal, with the space therebetween filled with foam insulation as known in the art. A mullion 32 extends across the front opening 18 between the drawers 26 and 28 to support the front edge of the partition 20, which is suitably supported at its side and back edges as well. The mullion 32 can be heated by a low wattage surface heater (not shown) to remove any condensation that may occur during operation of the refrigerator.

Each of the pull-out drawers 26 and 28 have a front door panel 34 with a handle 36 along a top edge and which is designed to be fit with an overlay panel (not shown) matching the cabinetry where the unit is installed. Details of the handle construction and the overlay panel attachment can be found in co-owned pending application Ser. No. 10/076,746, filed Feb. 14, 2002. Attached to the door panels 34 are drawer bins 38 and 39 of slightly different configuration between the respective upper 26 and lower 28 drawers. The upper drawer 26 has deeper opposite side walls 40 joined at their bottom edges to a bottom wall 42 and at their back edges by a vented rear wall 44 that extends only about half the height of the side walls 40 so that its top edge is set down from the top edges of the side walls 40. Two, preferably plastic, runners 46 are attached, preferably with adhesive, onto the top edges of the side walls 40 to allow a bottle bin 48 to slide thereon.

In particular, with reference to FIGS. 4–7, the bottle bin 48 has guides 50 at its sides that wrap over the top of the runners 46 to allow front to back sliding but limit side to side motion. The bottle bin 48 can slide from forward travel limiting stops 43 projecting up from the side walls 40 to the rear wall 44 and even past the rear wall 44 when the drawer 26 is open sufficiently so as to nearly completely clear from the top of the drawer 26 and allow nearly full access to the items in the drawer bin. This full retraction of the bottle bin 48 is permitted by the clearance of the half-height rear wall 44 and by hold-down brackets 52 welded to the side walls 40 and spaced vertically from the runner 46 that capture the top end of the bottle bin guides 50. The brackets 52 hold down the front side of the bottle bin 48 to prevent it from tipping backwards when fully retracted and rearward travel limiting stops 45 projecting up from the tops of the guides 50 contact the brackets 52 and prevent the bottle bin 48 from sliding off of the drawer bin 38 (see FIG. 6). The bottle bin 48 can be removed by pulling it toward the door panel 34 and tilting its front end up until its back end clears the brackets 52.

Figure 7:
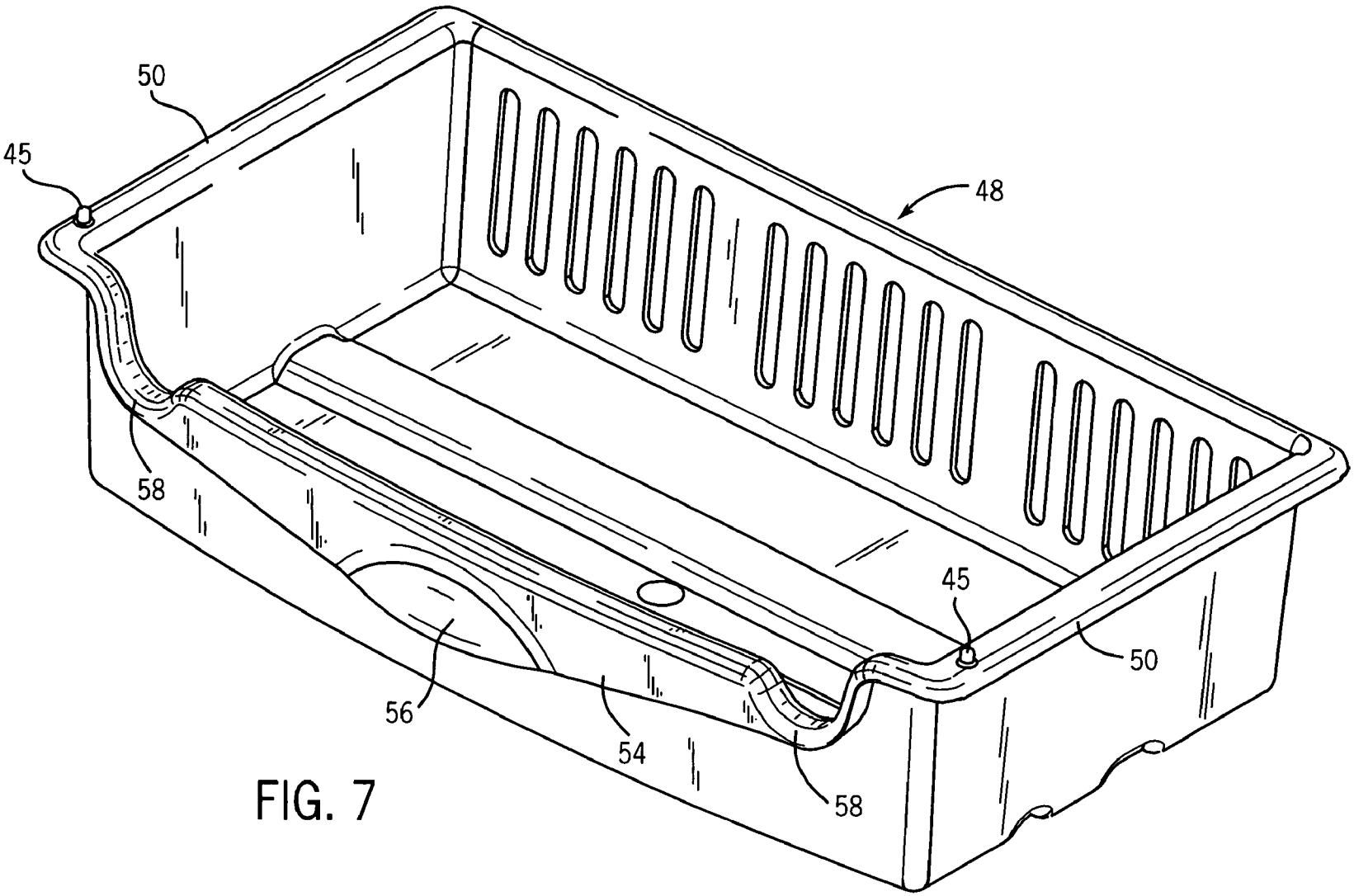
FIG. 7 is a perspective view of the bottle bin.

As shown in FIG. 7, the bottle bin 48 is a molded plastic tray or container having a bottom and four upright walls. The back wall is vented and the lip or flange of the side walls defines the guides 50. The front wall bows slightly and extends to a lesser height that the other walls. The curled lip 54 of the front wall defines a handle 56 in the middle as well as two bottle retainers 58 in the form of round, nearly semi-circular recesses. These bottle retainers 58 are designed to cradle the necks of wine, soda and like bottles that may be stored in the bottle bin 48. The front to back dimension of the bottle bin 48 is designed to allow standard wine bottles to lie flat in the bottle bin 48 with the neck cradled in the bottle retainers 58 and the side to side dimension allows standard 2-liter bottles to lie across the bottle bin 48. As the name suggests, the bottle retainers 58 secure the bottles by resisting side to side as well as back to front movement of the bottles. Yet, they allow the bottles to be simply lifted from the bottle bin 48 when desired.

Figure 8:
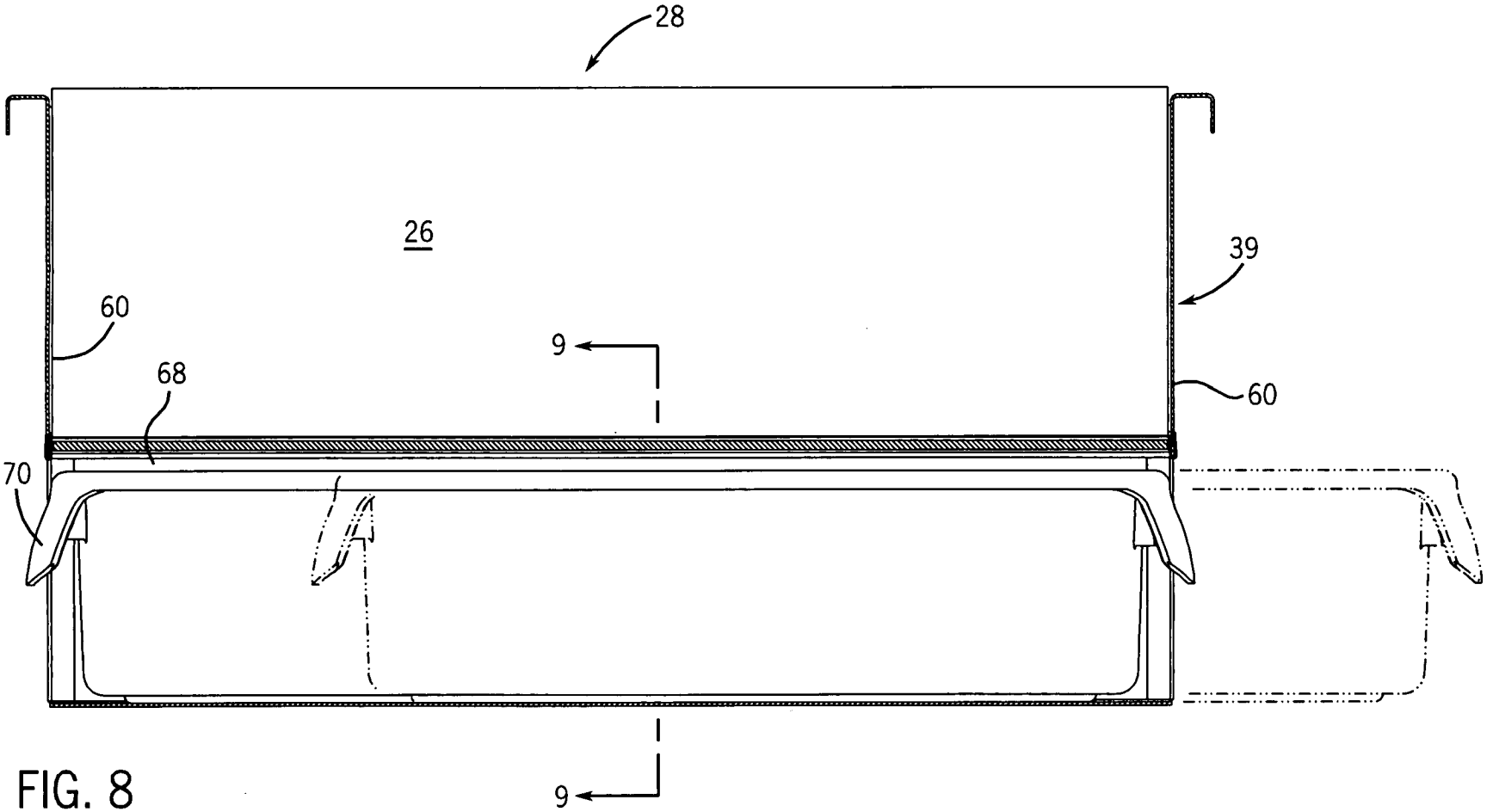
FIG. 8 is a front sectional view of a lower drawer showing a side access compartment containing a slide out storage bin.
Figure 9:
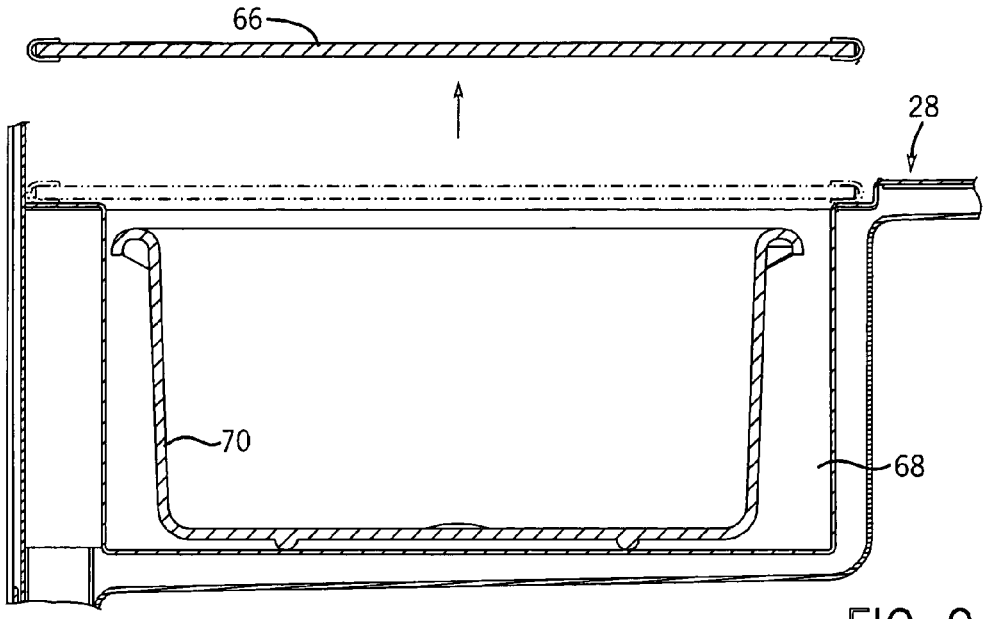
FIG. 9 is a partial side sectional view of the lower drawer and side access compartment with a translucent panel shown removed.
Figure 12:
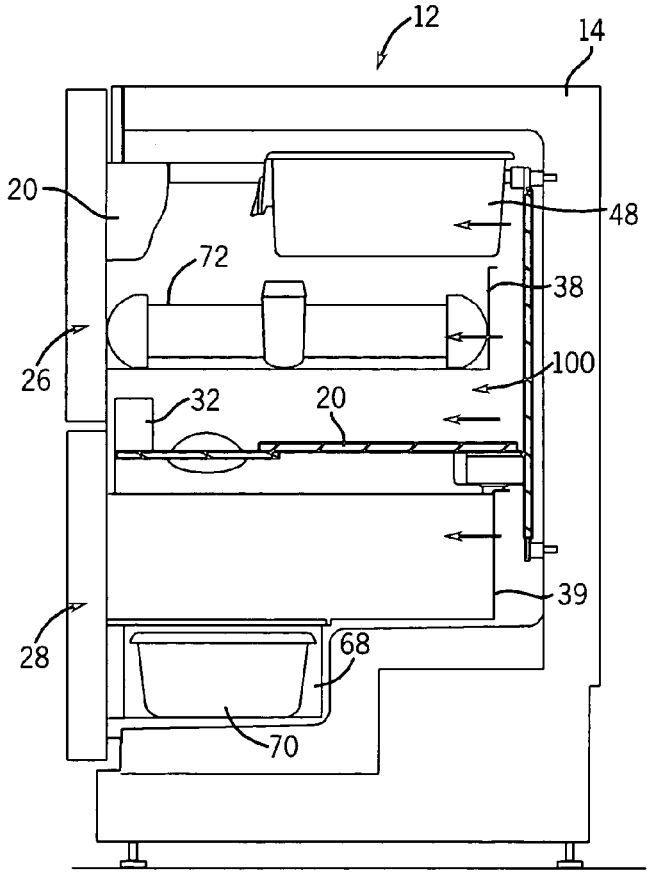
FIG. 12 is a diagrammatic representation of the inside of the refrigerator cabinet with arrows representing the generally segregated air masses in the upper and lower drawer cavities.
Figure 10:
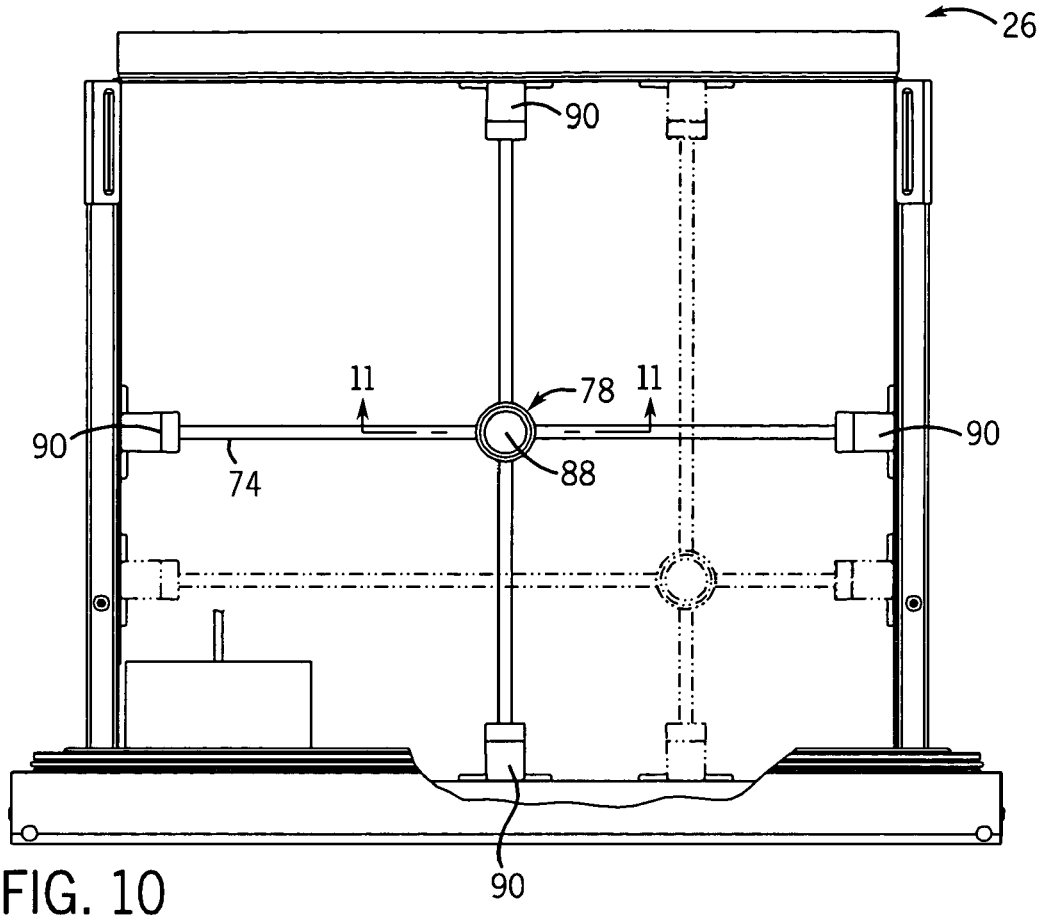
FIG. 10 is a top view looking down into the upper drawer at an adjustable fence mechanism therein.
Figure 11:
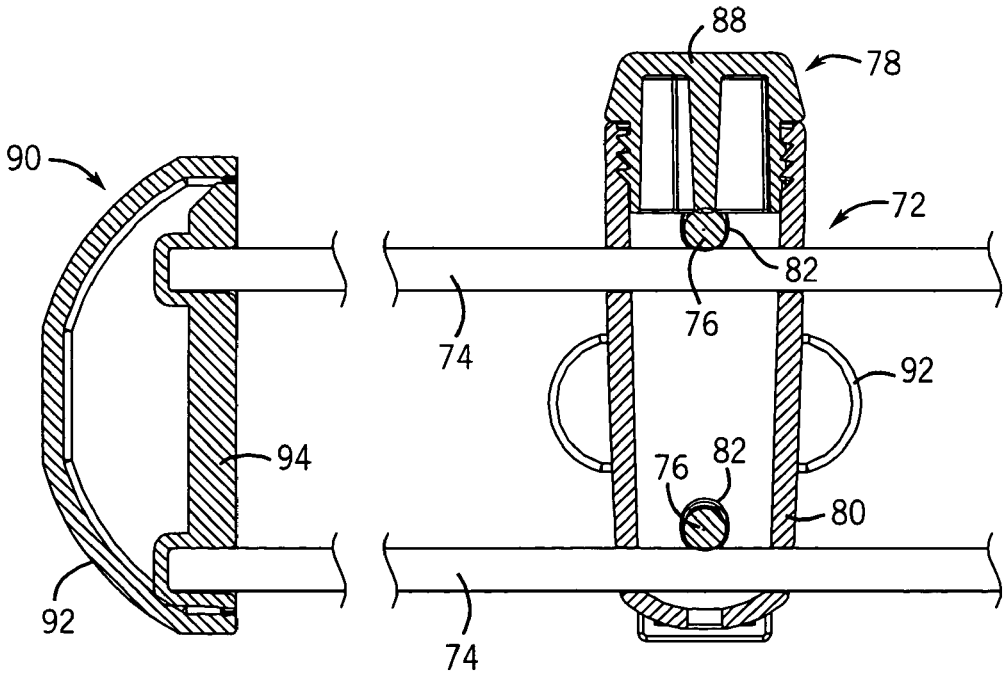
FIG. 11 is a cross-sectional view taken along line 11—11 of FIG. 10 showing the locking hub feature of the adjustable fence.

Referring to FIGS. 8 and 9, the lower drawer 28 has a shallower drawer bin 39 defined by shorter side 60 and rear 62 walls. The bottom 64 of the drawer bin 39 is formed in part by a translucent removable panel 66 that permits viewing, and removed access, into a side access compartment 68 located beneath the drawer bin 39 behind the door panel 34. This compartment 68 is a channel, generally rectangular in cross-section and parallel to the door panel 34, that is open-ended at the sides of the drawer 28. The compartment 68 holds a plastic storage bin 70, such as a crisper tray, that when the drawer 28 is open can fit into and be removed from the compartment 68 from either open end or from its top side through the interior of the drawer bin 39 by lifting off panel 66 (and any items stored thereon).

Figure 15:
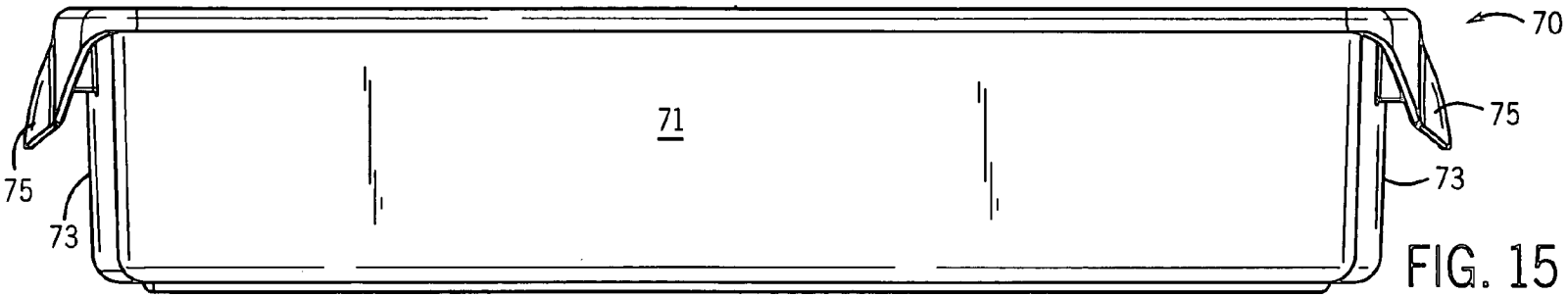
FIG. 15 is a side elevational view of the slide out storage bin shown in FIG. 8.
Figure 16:
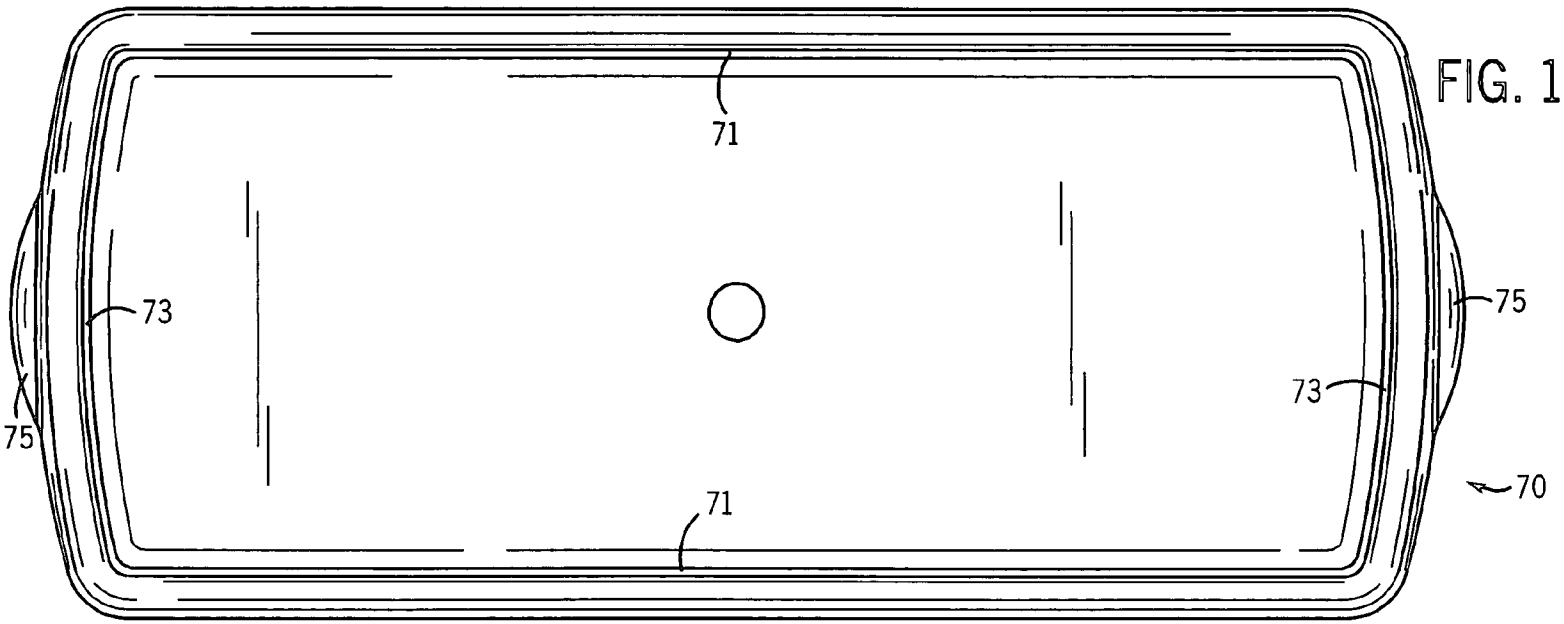
FIG. 16 is a top plan view thereof.

With reference to FIGS. 15 and 16, the storage bin 70 has a curved upper periphery or rim extending along its long sides 71 and short ends 73. The curved periphery forms two handles 75 at the short ends. The handles 75 and other portions of the curved periphery is rounded at the ends. The handles 75 generally following one radius and the other portions of the periphery generally following another, larger radius between the sides 71 such that the outer edge of the periphery is farthest from the ends 73 at about the midpoint of the handles 75. This rounded contour at the ends is designed to self-align the storage bin 70 if it is slid it into the compartment 68 misaligned or somewhat off center of the openings of the compartment 68.

As shown in FIGS. 2–3 and 10–11, an adjustable divider fence 72, shown herein in the upper drawer bin 38 (although usable in either or both the upper or lower drawing bins), has two lateral divider rods 74 spaced apart vertically and in parallel and two transverse divider rods 76 also spaced apart vertically in parallel and perpendicular to the lateral divider rods 74. The lateral divider rods 74 extend between the side walls 62 and the transverse divider rods extend between the inside of the door panel 34 and the rear wall 64, and thus in this case are shorter than the lateral divider rods 74. The pairs of divider rods 74 and 76 are coupled together and held in a perpendicular crisscross configuration by a hub 78 having a body 80 with two sets of two openings 82 (one set shown) through which the divider rods extend and an upper threaded opening 86 in which threads a locking turn knob 88. The lower end of the knob 88 is sized so that when the knob 88 is tightened it contacts the upper lateral divider rod and presses it against the upper transverse divider rod so that their relative positions are fixed (see FIG. 11). When the knob 88 is loosened, the hub 78 can be slid along the pairs of divider rods to create four compartments. When the hub 78 is centered in the drawer bin 38, the four compartments will be essentially equally sized. The fence 52 can thus be used to compartmentalize the drawer bin 39 or to keep stored items secured from movement. If it is not desired to divide up the drawer bin 38, the fence 72 can be adjusted so that the hub 78 is near one corner of the drawer bin 38 so that the lateral divider rods 74 are near the front or rear wall and the transverse divider rods 76 are near one of the side walls. Or, the entire fence 72 can be simply lifted out of the drawer bin 38. The ends of the each pair of divider rods 74 and 76 are coupled together with end assemblies 90 that include flat, cross-shaped contact pads 92 and an end piece 94, which is pressed onto the rods and ultrasonically welded over an opening in the body of the contact pads 92. Preferably, the divider rods are metal and the hub and the contact pads are plastic.

Figure 13:
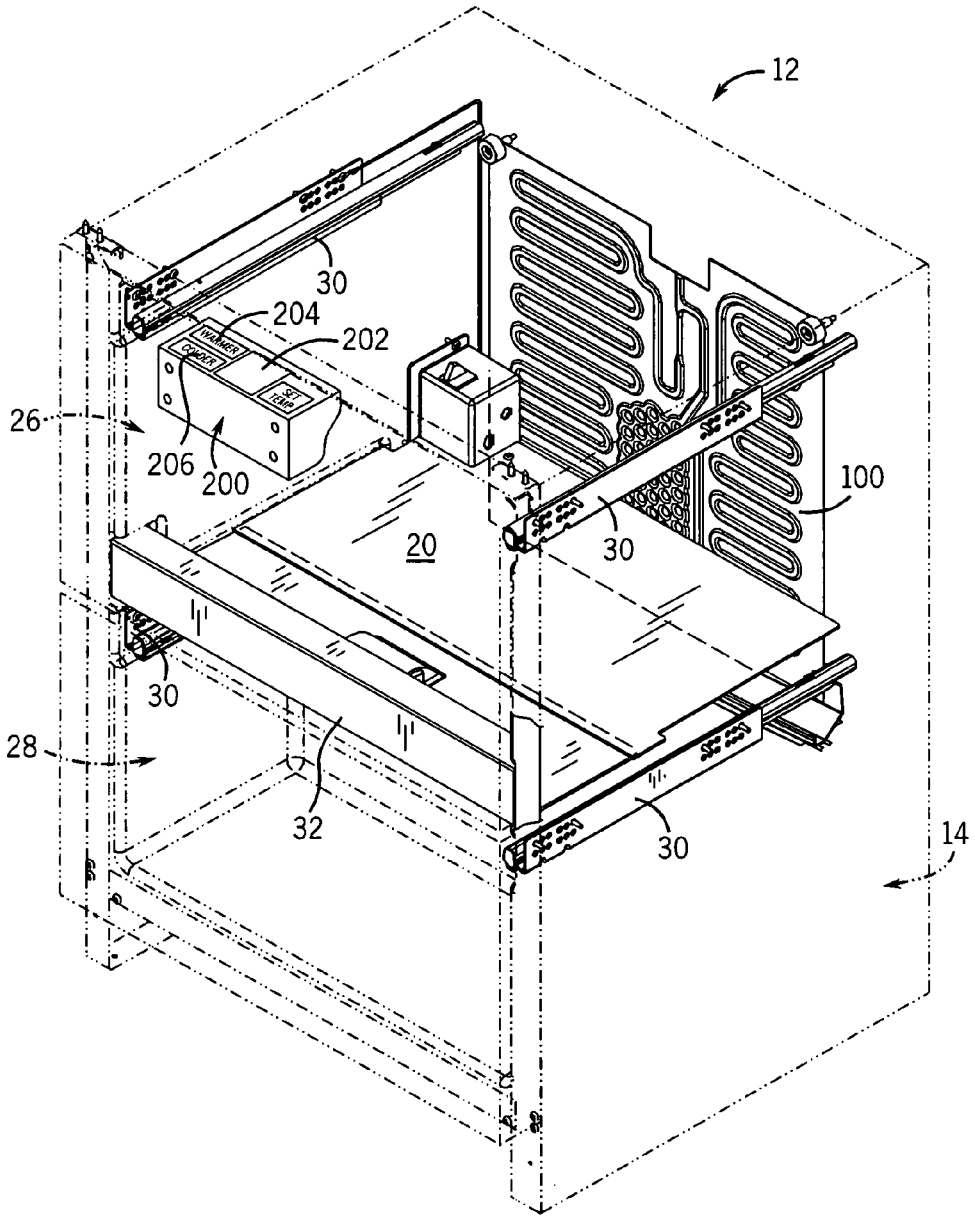
FIG. 13 is a perspective view of various internal components of the refrigerator, including slide mechanisms, a control unit, a partition and the evaporator, with the cabinet and drawers shown in phantom.
Figure 14:
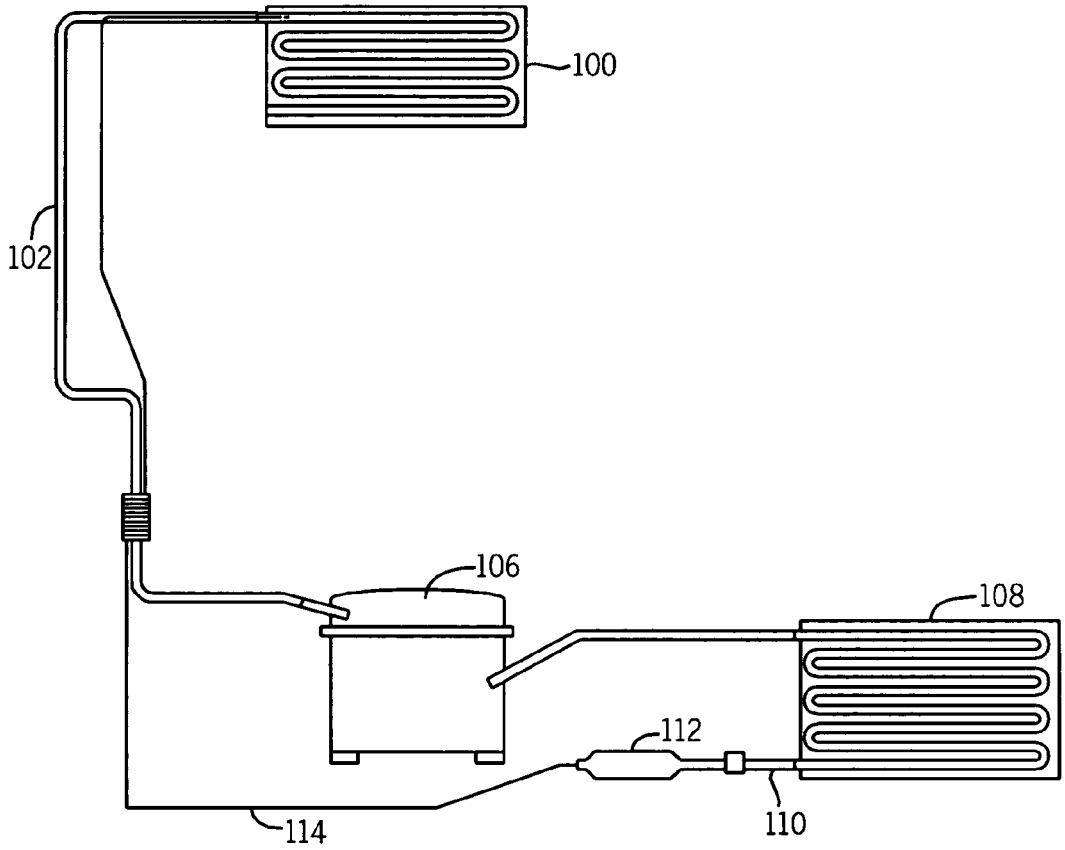
FIG. 14 is a schematic diagram of the refrigeration system of the drawer refrigerator.

The refrigerator is cooled by a generally conventional refrigeration system, shown schematically in FIG. 14, includes an evaporator 100 attached to the rear wall within the interior of the cabinet 14, as shown in FIG. 13. The evaporator 100 has an integral accumulator and an outlet line 102 which passes gas refrigerant to a compressor 106. The output of the compressor 106 is connected to the inlet of a condenser 108 having an outlet line 110 connected to a dryer 112. A small diameter capillary tube 114 leads from the dryer 112 to an inlet of the evaporator 100.

As is known, the compressor 106 draws refrigerant from the evaporator 100 and accumulator 104 and discharges the refrigerant under increased pressure and temperature to the condenser 108. The hot refrigerant gas entering the condenser 108 is cooled by air circulated by a fan 116 (see FIG. 2). As the temperature of the refrigerant drops under substantially constant pressure, the refrigerant in the condenser 108 liquefies. The capillary tube 114 maintains the high pressure in the condenser 108 and at the compressor outlet while providing substantially reduced pressure in the evaporator 100. This reduced pressure results in a large temperature drop and subsequent absorption of heat by the evaporator 100. The compressor 106, condenser 108, and fan 116 are located at the bottom of the cabinet 10 beneath the insulated portion (see FIG. 2).

The single naturally convective evaporator 100 extends along the rear wall at the inside of the cabinet so as to be adjacent both upper and lower drawer cavities 22 and 24. The horizontal partition 20, which divides the interior of the cabinet in two, is designed to divide or partition the evaporator 100 in two parts, preferably so that more (about ⅔) of the evaporator 100 is located in the upper drawer cavity 22 than in the lower drawer cavity 24, and to restrict air flow between the cavities 22 and 24 so that chilled air from the evaporator 100 is essentially trapped in each and segregated from the other drawer cavity so that the cabinet has a nearly uniform temperature at each drawer cavity 22 and 24. The partition helps prevent cold air from settling near the bottom of the cabinet and prevents the temperature in the lower drawer from being substantially cooler than that in the upper drawer. The vented rear walls of the bottle bin 48 and the upper drawer bin 38 also allow cool air from the evaporator to reach the food in the upper drawer 26, further aiding in cooling the upper part of the cabinet and equalizing the temperature in the drawers. While zero temperature differential between the drawers is desired, a five or six degree temperature variance, for example three degrees plus or minus from the target temperature, is generally an acceptable working temperature differential. Empirical tests have found that maximum temperature differences between the two drawers is 2.4° F. when the external ambient temperature is approximately 90° F. and a target cooling temperature is about 36–38° F., with the mean temperature differential being even better at 1.2° F. Because the test results may vary depending on the temperature of the food inside the drawers, for consistency the test were conducted with the refrigerator completely unloaded. Individual units tested under the same conditions achieved a nearly zero degree differential, for example 0.4° F., which is expected to improve and be at or very near zero with lower ambient temperatures (near 70° F.) common in homes and business environments. A primary benefit of this uniform temperature afforded by the refrigerator of the present invention is that, in non-freezer applications, the temperature can be set to a target temperature which approaches freezing, for example 34–36° F. with the actual temperatures within the drawer at the high end being sufficiently cool and the lower end actual temperatures remaining above freezing.

The refrigeration system is operated and controlled by a control unit 200 mounted in the interior of the upper drawer 26 (preferably in the left front corner). The control unit 200, shown in FIG. 13, has an LED display 202 providing actual and set temperature readings and has temperature adjustment buttons, preferably in the form of warmer 204 and cooler 206 sealed buttons. The control unit 200 could also have indicator lights (not shown) providing the user or service technician visual indication of refrigeration error conditions or cycle status.

Thus, the present invention provides a pull-out drawer type refrigerator with several features to improve ease of use and functionality. The sliding bottle bin provides extra storage for wine or like bottles without hampering access to the items stored in the associated drawer bin. The side access compartment also provides additional storage space in a pull out bin that is easily accessible from either side or the top of the associated drawer. The adjustable fence quickly and easily compartmentalizes the drawer bins for segregated storage of items and can be used to secure taller items in place to prevent tipping. The size of the compartments can be adjusted easily by turning the locking knob and sliding the dividers as desired. The dividers can be slid near perpendicular walls of the drawer bin or removed completely when there is no need to divide up the storage space. Finally, the invention provides for nearly constant and equal temperatures at the drawer bins of multiple pull-out drawers using a single partitioned naturally convective evaporator.

It should be appreciated that merely a preferred embodiment of the invention has been described above. However, many modifications and variations to the preferred embodiment will be apparent to those skilled in the art, which will be within the spirit and scope of the invention. Therefore, the invention should not be limited to the described embodiment. To ascertain the full scope of the invention, the following claims should be referenced.

We claim:

1. A drawer refrigerator having an evaporator, a compressor receiving return refrigerant from the evaporator and a condenser coupled to the compressor and to the evaporator through a restriction, the drawer refrigerator comprising:

a cabinet defining a cavity with a front opening;

a pull-out drawer slidably mounted within the cavity of the cabinet and having a door panel at least partially closing the front opening and a drawer bin mounted to the door panel; and a bottle bin slidably supported by the drawer bin having a bottle retainer for receiving a neck of a bottle contained in the bottle bin.

2. The drawer refrigerator of claim 1, wherein the bottle retainer is a unitary feature of the bottle bin.

3. The drawer refrigerator of claim 2, wherein the bottle retainer is a recess in an upright wall of the bottle bin.

4. The drawer refrigerator of claim 3, wherein the recess is located at a front of the bottle bin.

5. The drawer refrigerator of claim 2, wherein the bottle bin has a plurality of bottle retainers.

6. The drawer refrigerator of claim 2, wherein the bottle bin has guides located at opposite sides that engage opposite side walls of the drawer bin so as to be slidable along the side walls of the drawer bin.

7. The drawer refrigerator of claim 6, wherein a portion of the bottle bin is slidable beyond a rear wall of the drawer bin.

8. The drawer refrigerator of claim 2, wherein the bottle bin has a unitary handle.

9. A drawer refrigerator having an evaporator, a compressor receiving return refrigerant from the evaporator and a condenser coupled to the compressor and to the evaporator through a restriction, the drawer refrigerator comprising:

a cabinet defining a cavity with a front opening;

a pull-out drawer slidably mounted within the cavity of the cabinet, the drawer having a front door panel at least partially closing the front opening, a drawer bin mounted to the door panel, and a side access compartment opening to a side of the drawer bin perpendicular to the door panel; and a storage bin disposed in the side access compartment and removable therefrom from the side of the drawer bin when the drawer is in an open position in which the door panel is spaced from the cabinet;

wherein the side access compartment is disposed beneath the drawer bin.

10. The drawer refrigerator of claim 9, wherein the side access compartment extends between opposite sides of the drawer bin parallel with the door panel.

11. The drawer refrigerator of claim 10, wherein the side access compartment is open-ended at opposite sides so that the storage bin can be accessed from opposite sides of the drawer generally perpendicular to the door panel.

12. A drawer refrigerator having an evaporator, a compressor receiving return refrigerant from the evaporator and a condenser coupled to the compressor and to the evaporator through a restriction, the drawer refrigerator comprising:

a cabinet defining a cavity with a front opening;

a pull-out drawer slidably mounted within the cavity of the cabinet, the drawer having a front door panel at least partially closing the front opening, a drawer bin mounted to the door panel, and a side access compartment opening to a side of the drawer bin perpendicular to the door panel; and a storage bin disposed in the side access compartment and removable therefrom from the side of the drawer bin when the drawer is in an open position in which the door panel is spaced from the cabinet;

wherein the drawer includes a transparent bottom portion for viewing an interior of the side access compartment from an interior of the drawer bin.

13. The drawer refrigerator of claim 12, wherein the transparent bottom portion is a removable panel.

14. A drawer refrigerator having an evaporator, a compressor receiving return refrigerant from the evaporator and a condenser coupled to the compressor and to the evaporator through a restriction, the drawer refrigerator comprising:

a cabinet defining a cavity with a front opening;

a pull-out drawer slidably mounted within the cavity of the cabinet, the drawer having a front door panel at least partially closing the front opening, a drawer bin mounted to the door panel, and a side access compartment opening to a side of the drawer bin perpendicular to the door panel; and a storage bin disposed in the side access compartment and removable therefrom from the side of the drawer bin when the drawer is in an open position in which the door panel is spaced from the cabinet;

wherein the storage bin has edge surfaces designed to self-align the storage bin as it is positioned within the side access compartment.

15. The drawer refrigerator of claim 14, wherein the edge surfaces are rounded peripheral end surfaces.

16. A drawer refrigerator having an evaporator, a compressor receiving return refrigerant from the evaporator and a condenser coupled to the compressor and to the evaporator through a restriction, the drawer refrigerator comprising:

a cabinet defining a cavity with a front opening;

a pull-out drawer slidably mounted within the cavity of the cabinet having a front door panel at least partially closing the front opening and a drawer bin having a bottom, rear and opposite side walls; and a divider fence disposed within the drawer bin having a lateral divider extending being the side walls thereof and a transverse divider extending between the door panel and the rear wall of the drawer bin, the lateral and transverse dividers between coupled and releasably locked together at a hub such that when the hub is unlocked the transverse divider can slide between the sides of the drawer bin and the lateral divider can slide between the door panel and the rear wall of the drawer bin independent of the position of the other divider.

17. The drawer refrigerator of claim 16, wherein the hub of the divider fence includes a locking member contacting one of the dividers and pressing it against the other divider to inhibit relative movement.

18. The drawer refrigerator of claim 17, wherein the hub further includes a body having openings through which the dividers pass.

19. The drawer refrigerator of claim 18, wherein the locking member is a threaded knob that threads into a mating opening in the hub body.

20. The drawer refrigerator of claim 16, wherein the dividers are elongated rods.

21. The drawer refrigerator of claim 16, wherein the dividers have contact pads at each end.

22. The drawer refrigerator of claim 16, wherein there are two lateral dividers spaced apart in parallel and two transverse members spaced apart in parallel.

23. The drawer refrigerator of claim 21, wherein the two lateral dividers and the two transverse dividers are spaced apart vertically.

24. A drawer refrigerator, comprising:

a cabinet defining an interior chamber with a front opening and having a partition dividing the chamber into two drawer cavities one vertically above the other;

two pull-out drawers each slidably mounted to the cabinet so that a drawer bin is disposed in one of the drawer cavities when the drawer is in a closed position in which a front door panel thereof closes the associated drawer cavity; and a refrigeration system including a single evaporator, a compressor receiving return refrigerant from the single evaporator and a condenser coupled to the compressor and to the single evaporator through a restriction;

wherein the single evaporator is disposed within the interior chamber of the cabinet along a rear wall thereof so as to extend adjacent both drawer cavities and is partitioned vertically by the partition such that the temperature difference within the cabinet interior cavity is no more than about three degrees Fahrenheit at each drawer cavity when the drawers are unloaded.

25. The drawer refrigerator of claim 24, wherein the temperature difference is essentially zero.

26. The drawer refrigerator of claim 24, wherein the cabinet includes a mullion extending between opposite upright side walls at the front opening.

27. The drawer refrigerator of claim 24, wherein more of the evaporator is disposed in an upper drawer cavity than in a lower drawer cavity.

* * * * *